US006807880B1

(12) United States Patent
Brian et al.

(10) Patent No.: US 6,807,880 B1
(45) Date of Patent: Oct. 26, 2004

(54) MECHANICAL NUT AND STUD REMOVAL TOOL

(76) Inventors: Ronnie Brian, Old Station House, Green Row, Methley, West Yorkshire (GB), LS26 9BR; David Brian, 14 Brook Street, Fryston Village, Castleford, West Yorkshire (GB), WF10 2PL ( * ) Notice: Subject to any disclaimer, the term of this patent is extended or adjusted under 35 U.S.C. 154(b) by 0 days.

(21) Appl. No.: 09/868,419

(22) PCT Filed: Dec. 9, 1999

(86) PCT No.: PCT/GB99/04137

§ 371 (c)(1),
(2), (4) Date: Jun. 19, 2001

(87) PCT Pub. No.: WO00/35636

PCT Pub. Date: Jun. 22, 2000

(30) Foreign Application Priority Data

| | | |
|---|---|---|
| Dec. 15, 1998 | (GB) | 9827489 |
| Feb. 8, 1999 | (GB) | 9902600 |
| Apr. 27, 1999 | (GB) | 9909543 |

(51) Int. Cl.[7] ..... B25B 13/50
(52) U.S. Cl. ..... 81/53.2; 81/441
(58) Field of Search ..... 8/53.2, 120, 441

(56) References Cited

U.S. PATENT DOCUMENTS

| | | | | |
|---|---|---|---|---|
| 1,314,812 A | * | 9/1919 | Jones | 81/120 |
| 1,472,517 A | * | 10/1923 | Fry | 81/120 |
| 1,479,642 A | * | 1/1924 | Bizzell | 81/120 |
| 1,493,762 A | * | 5/1924 | Mannon et al. | 81/441 |
| 1,724,312 A | * | 8/1929 | Pugh | 81/441 |
| 1,777,936 A | * | 10/1930 | Roberts | 81/441 |
| 2,747,449 A | * | 5/1956 | Metcalf | 81/53.2 |
| 4,572,035 A | | 2/1986 | Eisenhauer | |
| 4,688,315 A | * | 8/1987 | Jannke | 81/53.2 |
| 4,713,990 A | | 12/1987 | Poling | |
| 5,068,954 A | | 12/1991 | Houska | |
| 6,047,620 A | * | 4/2000 | Kozak et al. | 81/441 |

FOREIGN PATENT DOCUMENTS

| | | |
|---|---|---|
| DE | 1 478 848 | 1/1969 |
| GB | 2 019 284 A | 10/1979 |

* cited by examiner

*Primary Examiner*—James G. Smith
(74) *Attorney, Agent, or Firm*—John A. Artz

(57) ABSTRACT

The invention concerns a tool for removing fastening members, such as nuts and studs. The tool comprises an elongate body member (30) with first and second ends, the first end having means (31') for deforming an end face of the fastening member to provide an area of purchase thereon; and means (44) to cause rotation of the fastening member to unscrew the fastening member from the structure. Also within the scope of the present invention is a locating means (38') for locating the first end of the body member (30') with respect to the end face of the fastening member as well as a method for enabling removal of fastening members by action upon an end face of a fastening member.

11 Claims, 7 Drawing Sheets

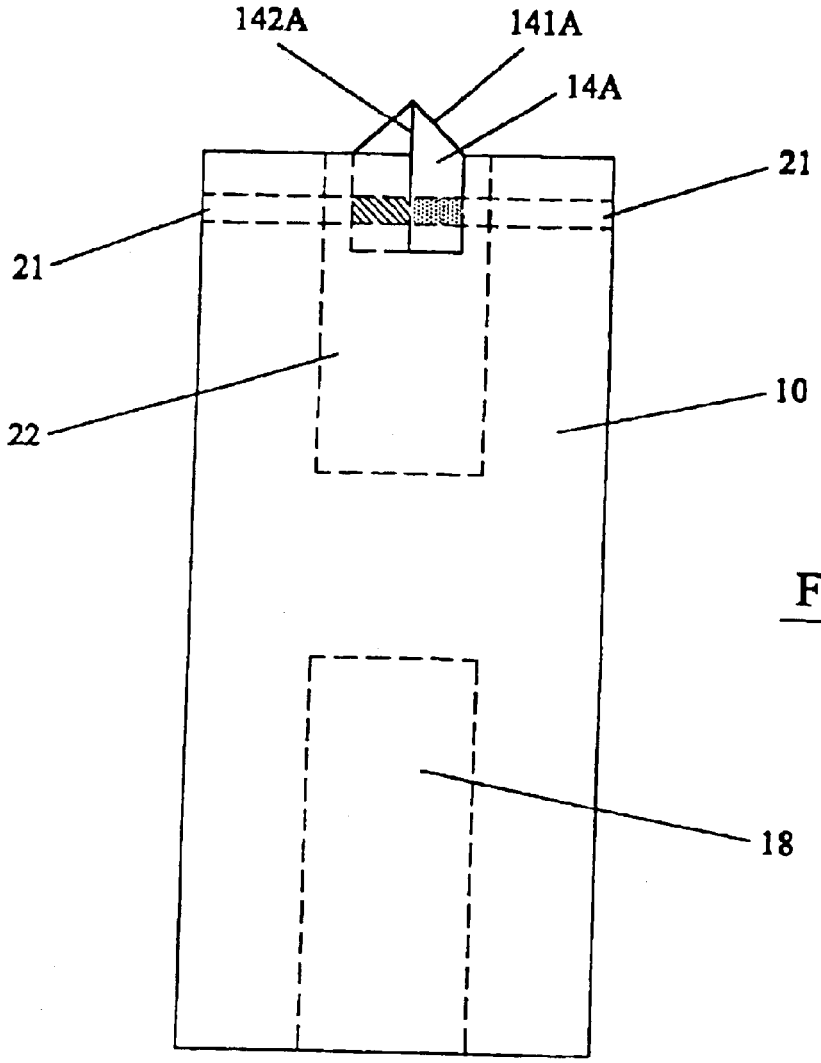
FIG. 5
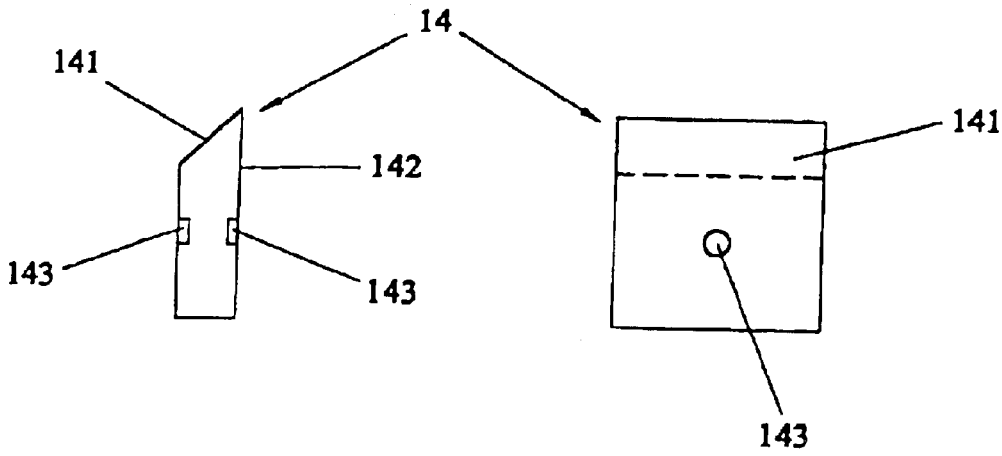
FIG. 6A
FIG. 6B

MECHANICAL NUT AND STUD REMOVAL TOOL

The invention relates to a tool for removing fastening members, in particular to a tool for removing nuts and studs.

Conventionally, nuts or studs would be removed by moving a spanner or a wrench which acts upon the side face of the nut or stud to cause its rotation. However, where the nut or stud has become damaged by its edges having become "rounded", it may be difficult to remove using the normal tools available. Also, in cases where nuts for instance have become seized, removal is problematic.

Existing methods for removing seized or damaged fastening members in such conditions involve drilling, burning or cutting the fastening member in question from the object to which they are attached.

Another problem which is often encountered concerns situations in which locking nuts have been used, but the specialized tool for unlocking of the nuts is not available.

In a common field of application, vehicles with alloy wheels utilize locking wheel nuts to prevent their theft. However, often the vehicle owner will not have the key or tool available in the event of a breakdown, for instance, after sustaining a flat tyre. Breakdown engineers called out to the scene often have very little option other than to tow the vehicle to a garage where further attempts would be made to remove the vehicle wheel in question. However, attempts at removal without the proper key or tool (which may well be for all practical purposes unique to the particular vehicle on which the alloy wheels are fitted) often result in damage to the wheel and add considerable time and expense to the repairs.

It will be appreciated that in the case of locking wheel nuts and in the case of seized or damaged fastening members in other situations, it may be only the end face of the particular fastening member which is accessible so that getting a good grip around the circumference of the fastening member is not a viable option.

In such cases, being able to only access the end face exacerbates the problem. Indeed, in the case of locking wheel nuts in particular there is often an outer shell which is arranged to be freely rotating with respect to a concealed and protected member underneath and in those cases attacking the outer shell using hammer and chisel etc or attempting to drill into the wheel nuts often results in the chisel face or the drill bit skating across the locking wheel nut and damaging the valuable alloy wheels.

It is an aim of preferred embodiments of the present invention to provide a tool for aiding the removal of fastening members which avoids, or alleviates to at least some extent, at least one of the problems described above in relation to the prior art.

According to a first aspect of the invention, there is provided a tool for aiding the removal of a fastening member from a structure to which it is attached by means of a threaded connection, the tool comprising: an elongate body member having first and second ends, the first end having means for deforming an end face of the fastening member to provide an area of purchase thereon; and means to cause rotation of the fastening member to unscrew the fastening member from the structure.

The fastening member may comprise a nut or stud.

Preferably, said means to cause rotation comprise attachment means for the attachment of an operating member. The attachment means is preferably located at the second end of the body member.

The attachment means may comprise a standard connection, such as a half inch square drive in the form or a male or female connection. Other standard or specialised connections may alternatively be employed of course.

The operating member may comprise an impact means such as an impact driver for both imparting a blow to the tool and providing the means for rotation. An impact driver may be provided with the tool as an integrated package.

It is also within the scope of the invention that a first operating member may be linked to the tool by way of the attachment means in a first step so as to provide an impact to the tool, and a second, different operating member may be connected to the attachment means during a second step for providing said rotation. The first operating means may comprise a bar or similar for receiving a blow from a hammer, and the second operating member may comprise, for instance, a wheel brace.

The means for deforming the fastening member may comprise at least one cutting means such as a blade or a blade ring having blades arranged around an aperture formed in the blade ring for biting into said end face. The blade may be demountably attached to the elongate body. The blade may include an angled cutting edge. The tool may include means for securing the blade to the elongate body, such as by grub screws. The blade may be handed, so as to be orientable in a first configuration for use with fastening members having a right hand threaded attachment, and to be orientable in a second configuration for use with fastening members having a left-handed threaded attachment.

The first end of the body member may be provided with an aperture running longitudinally through the centre of the body member. The aperture may run part way through the body member or it may run entirely through the body member. The aperture may couple with the attachment means of the second end. The first end may comprise, in such a way that it forms the attachment means, at least one blade. Preferably two blades, are provided on either side of the aperture. The aperture may enable a bolt or similar object, on which is threaded a fastening member, to be lowered into the body member such that the blades come into contact with an end face of said fastening member.

When situated within the body member, the bolt may form part of the attachment means.

It is another aim of certain embodiments to include some means for locating the first end of the body member with respect to the end face of the fastening member.

With a view to fulfilling the above aim, the tool is preferably provided with locating means to locate the first end with respect to the end face of the fastening member.

The locating means may comprise centralising means.

The locating means may comprise a mandrel for engagement with the end face of the fastening member.

The mandrel may be spring mounted within the body member.

The mandrel may be of male or female type.

Preferably the leading end of the mandrel is tapered.

According to another preferred feature of the invention, the tool is provided with means for preventing peripheral damage to the structure.

For example a cover or shroud may be provided to surround the means for deforming the end face of the fastening member.

According to a second aspect of the invention, there is provided a method for facilitating the removal of a fastening member from a structure to which it is attached by means of a threaded connection, the method comprising:

deforming an exposed end face of the fastening member to provide an area of purchase thereon; and rotating the fastening member using said area of purchase.

The method of the second aspect may include any one or more of the limiting features of the apparatus of the first aspect in any combination. The method may include the preliminary step of locating a first end of the tool with respect to the end face of the fastening member. This locating step preferably includes the use of the locating means.

Preferred embodiments of the invention will now be described with reference to the accompanying drawings, in which:

FIG. 5 is a side elevational view partially in cross-section of the second embodiment of the invention as shown in FIG. 4;

Figure 4:
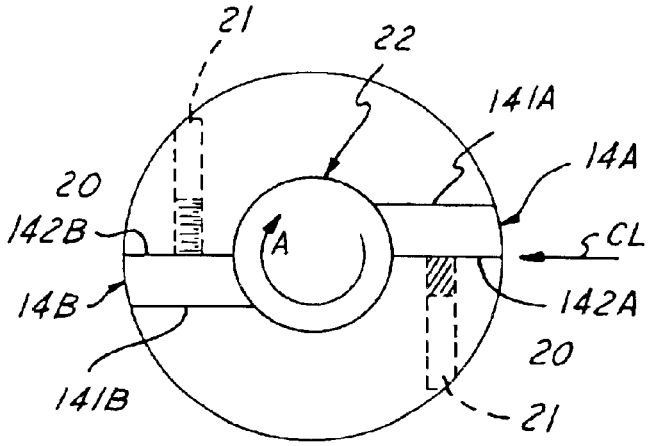
FIG. 4 is an end view of a tool according to a second embodiment of the invention.
Figure 7:
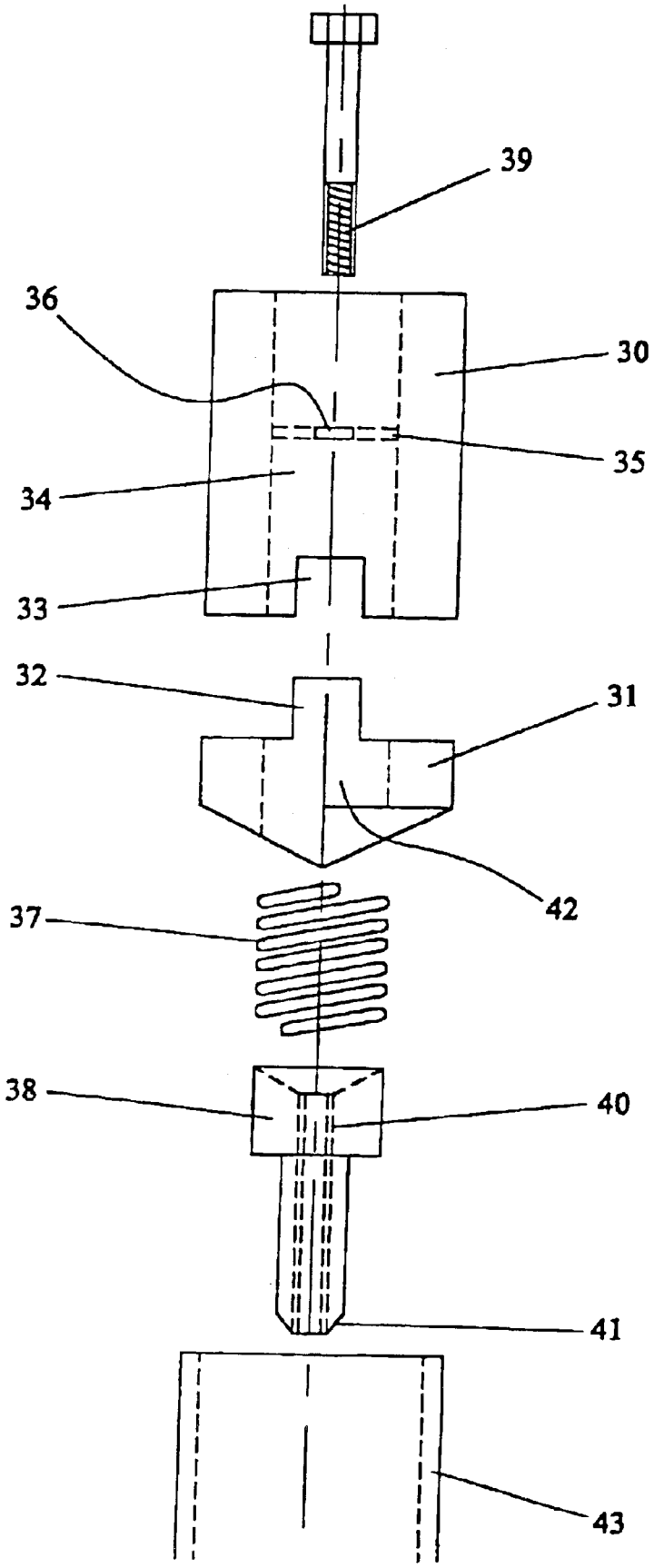

FIGS. 6A and B show an exemplary formation of a blade of the tool of FIGS. 4 and 5 in side elevation and front elevation respectively;

FIG. 7 is a diagrammatic exploded view of an embodiment of the invention including a locating means for locating the tool on an end face of the fastening member; and FIGS. 8, 9, 10 and 11 are exploded perspective views of three further embodiments of the invention.

Figure 1:
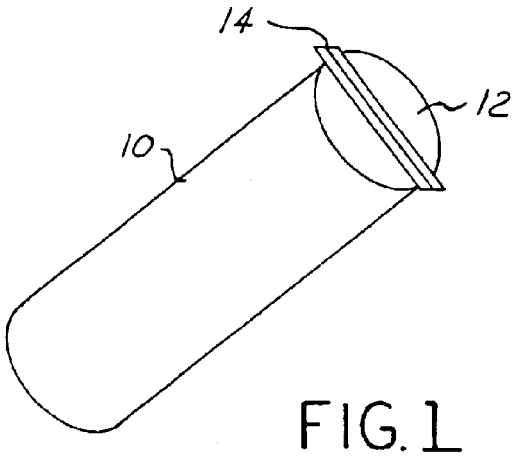
FIG. 1 is a perspective view of a tool according to a first embodiment of the invention.
Figure 2:
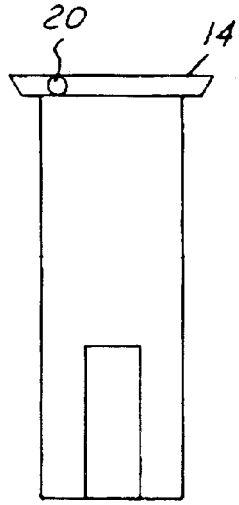
FIG. 2 is an end view of the first embodiment shown in FIG. 1.
Figure 3:
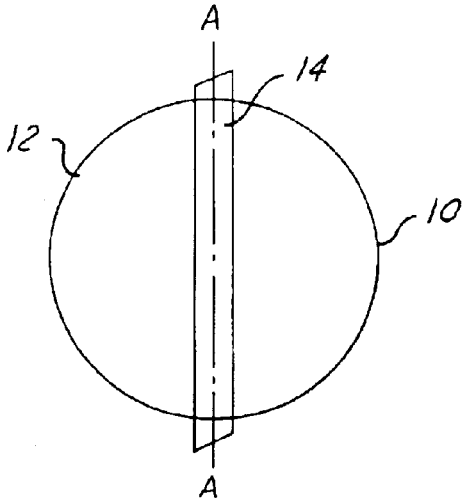
FIG. 3 is a cross-sectional view through the line A—A of the first embodiment shown in FIG. 1.

Referring to FIGS. 1 to 3, in the first embodiments of the invention, there is provided a tool comprising an elongate body member 10 having a first end 12 and a second end 16.

The first end 12 includes a cutting blade 14, connected to the elongate body 10 by means of grub screws 20.

The second end 16 contains a standard connection means 18, such as a half inch square drive connection, to which an impact driver or other suitable operating member may be attached, as best illustrated in FIG. 2.

In use, the blade 14 is placed into contact with the exposed end face of the fastening member to be released.

The second end 16 of the body member 10 is impacted by suitable means, such as by striking the end of an attached impact driver with a hammer. The impact causes the blade 14 to deform the end face of the fastening member, by biting into that end face and, in the case where the fastening member is a locking wheel nut having an outer shell and an inner nut, to cause the outer shell to lock with the inner nut.

Immediately after impact, the action of the impact driver causes rotation of the body member 10 which imparts rotational movement via the blade 14 to the fastening member.

Whilst it will be appreciated that some other operating means may be used to cooperate with the tool—for instance, a hammer could be first used to cause the deforming and a wheel brace could then be attached to the tool to provide the rotation—the use of an impact driver is most preferred. The reason that an impact driver is most preferred in the present invention is that during the imparting of the rotational force, the blade is further positively engaged with the deformed end face of the fastening member so as to provide extra security in use and greatly facilitate removal.

Referring now to FIGS. 4 and 5, a second embodiment of the invention is shown in plan view and side view (in direction CL of FIG. 4) respectively, with hidden detail shown by hatched lines (-----). This embodiment is particularly useful for removing a deformed or seized nut fastened to a bolt. The tool is generally similar to that shown in FIGS. 1 to 3 and points of similarity designated by like reference numerals will not be discussed further. However, the first end 12 of the tool incorporates a pair of blades 14A, B which are connected to the body member 10 by grub screws 20, running in threaded bores 21 and the two blades are separated by a gap 22 formed by an aperture running through the body member 10. This aperture or cavity 22 runs longitudinally through the body member and is centrally located along the desired axis of rotation.

FIGS. 6A and B show a typical blade 14 formation. It will be appreciated that the blade 14 has an angled cutting edge 141 which is arranged, in use, to bite into the end face of the fastening member to be deformed and a flat face 142, generally arranged in use to be at 90° to the end face of the fastening member. The angled face 141 in this way makes the deformation in the fastening member and the flat face is arranged to impart the rotational movement from the tools to the fastening member. The blade is "handed" in this way such that if the pair of blades 14A, B were fixed to the tool in the manner shown in FIGS. 4 and 5 then the direction of loosening is shown by Arrow "A". Loosening in this manner is brought about by the flat face 142 driving the fastening member. To cope with both left and right handed threads, the blade 14 may be removed and turned around such that the flat face 142 which includes a (optional) recess 143 for location of the grub screw 20, is always arranged to drive the rotation of the fastening member during a loosening operation.

In use, the tool of FIGS. 4 and 5 is positioned such that the cavity 22 receives the threaded end of a bolt or stud, to which the fastening member desired to be removed, is attached. The fastening member which will be assumed hereinafter to be a nut is brought into contact with the blades 14 by lowering the tool down the length of the bolt thread until the blades 14 engage with the end face of the nut.

Removal or loosening of the nut is then carried out in the same way as mentioned earlier, i.e. by imparting a blow to the second end of the tool 10 and rotating the tool to cause unscrewing of the nut from the bolt.

It will be appreciated that the cavity 22 may run throughout the length of the tool 10 and may, in itself, also form the means for connecting an impact driver. In otherwords, the aperture 22 need not be circular, but could adopt a complimentary formation to that of the particular drive means being utilised to facilitate operation.

Although two blades are shown in the embodiment of FIGS. 4 and 5, and a single blade shown in the embodiment of FIGS. 1 to 3, it will be appreciated that different numbers of blades may be utilised as required.

Referring now to FIG. 7, there will be described a locating means and method for locating the tool on the end face of the fastening member. As with other embodiments of the invention, the tool shown in FIG. 7 has a body member 30 which in use is fitted with blades 31. The blades 31 have a rib 32 which fits into a slot 33 extending across the body member 30.

The body member 30 has a passage 34 extending therethrough and within this passage there is a web 35 having a central aperture 36.

The lower end of the passageway 34 receives a compression spring 37 and a mandrel 38. The compression spring 37 acts between the mandrel and the web 35. The mandrel 38 is retained in position by a bolt 39 which passes through the hole 36 in the web 35 and into a threaded bore 40 in the mandrel 38. The leading end 41 of the mandrel is tapered.

When the tool is presented to the end face of the screw threaded member to be removed, the tapered end 41 of the mandrel 38 is projecting beyond the blades 31, since there is also a passageway 42 through the bladed member.

Thus, the leading end of the mandrel 38 may first be adjusted until it is in the exact centre of the exposed end face of the threaded member before an impact is delivered to drive the blades into the end face.

When the blades are driven into the end face, the mandrel 38 is depressed further into the body member 30 against the action of the spring 37.

To reduce the risk of peripheral damage to the surrounding structure containing the threaded member which is to be removed, the whole tool is provided with a cylindrical sleeve 43 to capture any debris from the blades and prevent this debris from reaching the surrounding structure.

The upper part of the passageway 34 may have a square cross section, so that a square key can be inserted into it to provide rotational movement to the tool.

The invention is not restricted to the features of the foregoing embodiment. For example, male and female members may be reversed. For example instead of using a male mandrel which fits into a socket in the body, a female mandrel could be provided which slides over a projecting part of the body.

Figure 8:
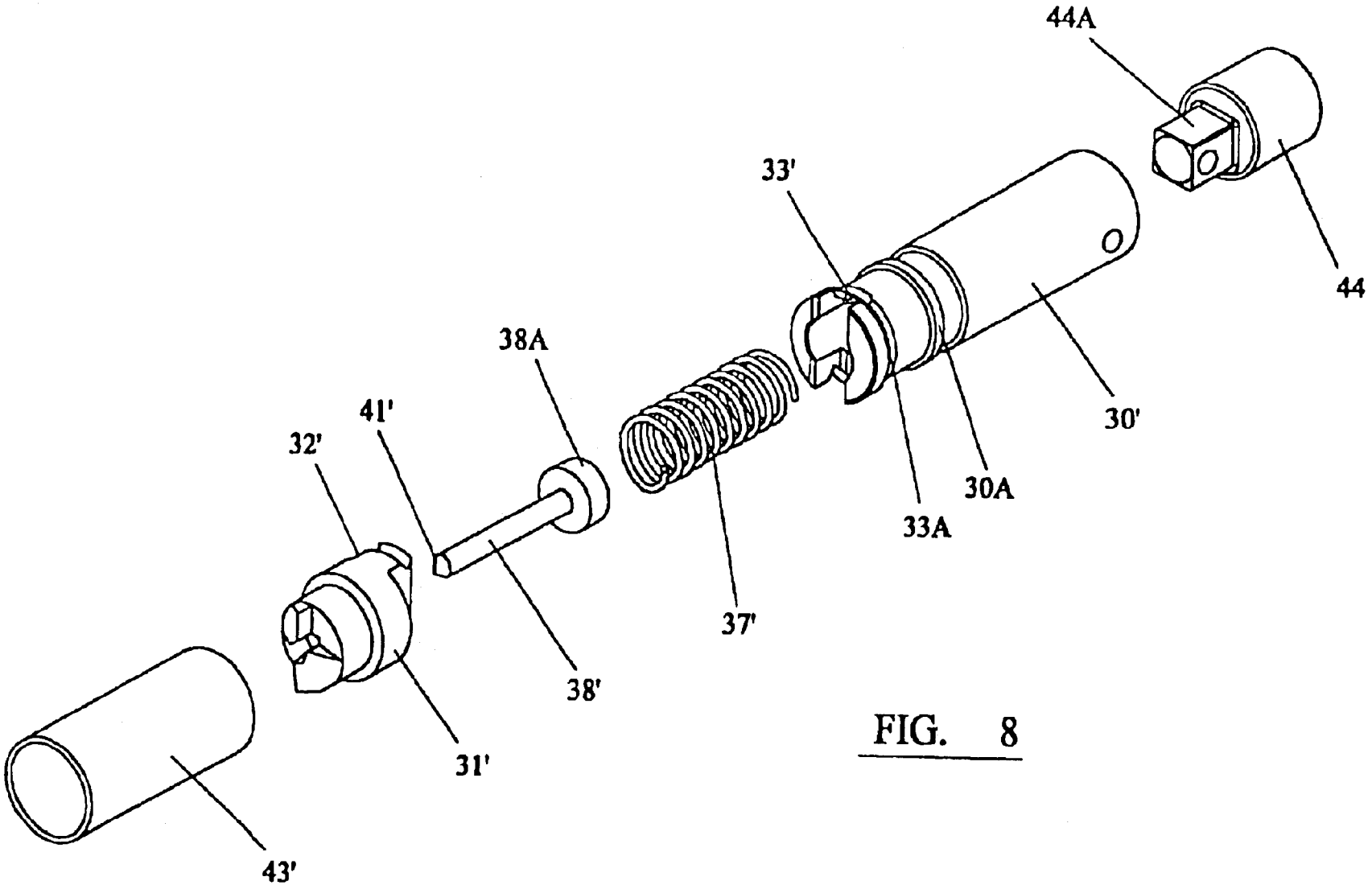
Figure 9:
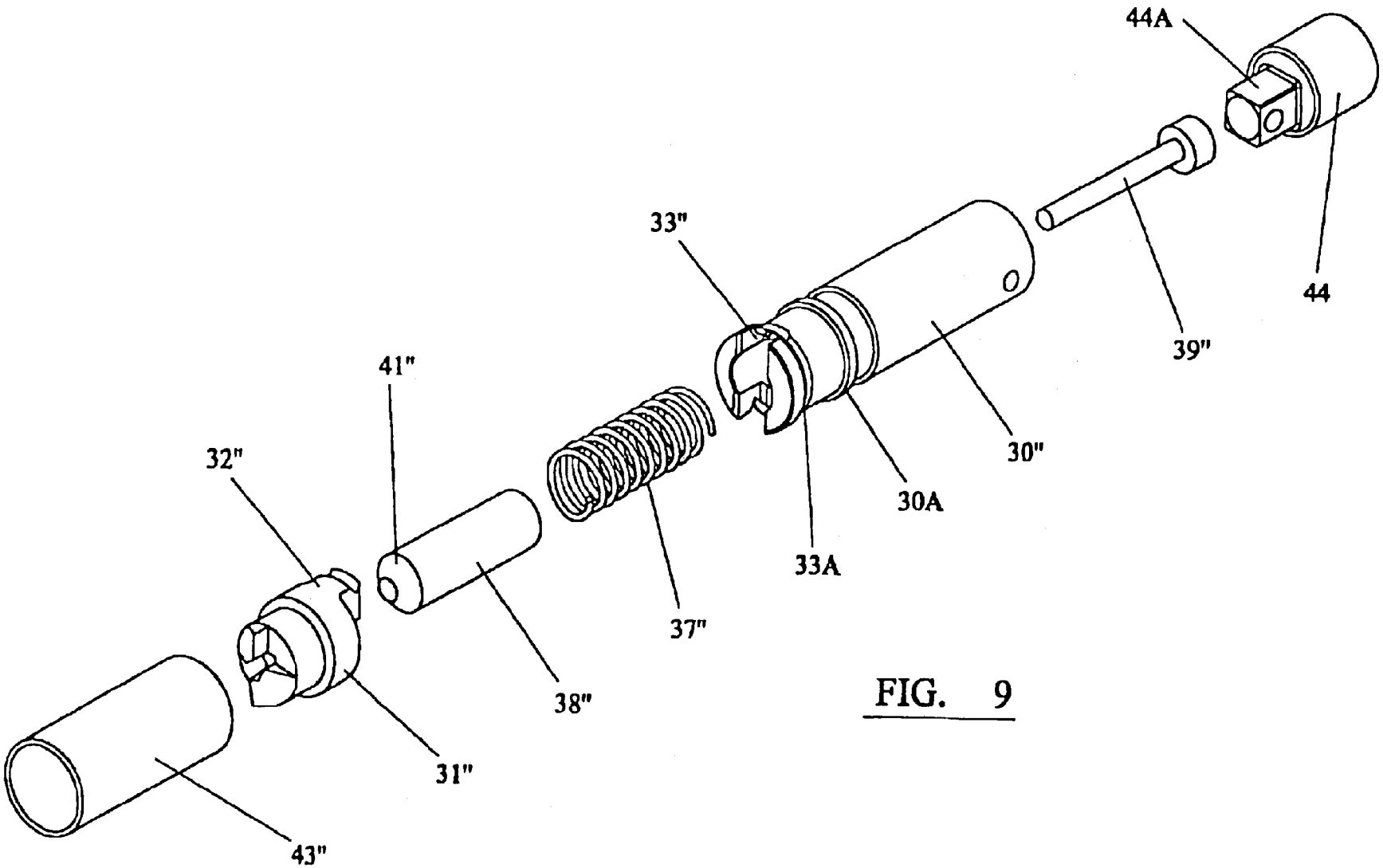
Figure 10:
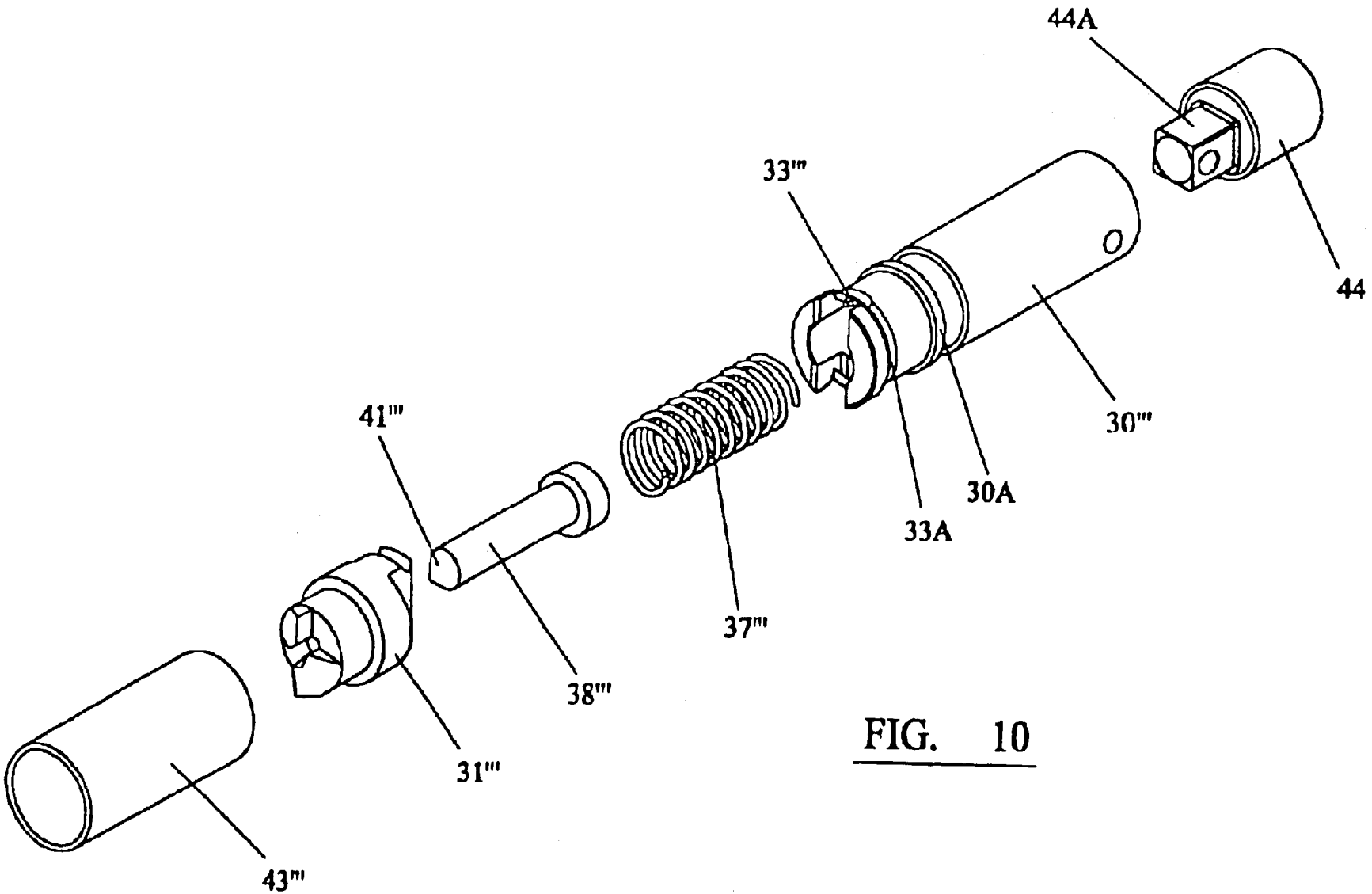

FIGS. 8 to 10 show further embodiments of the invention. Where there are presented like elements to those shown in FIG. 7, the same reference numbers will be utilized together with a prime (′), double prime (″) or triple prime (‴).

The embodiment of FIG. 8 is broadly similar to the embodiment of FIG. 7 aside from the fact that mandrel 38′ is arranged such that the spring 37′ locates within passageway 34 (not shown in this Figure) of the body member 30′ with the enlarged head 38A having the free end of the spring 37′ acting upon it so as to tend to keep the mandrel 38′ in a position in which the tapered head 41′ remains protruded beyond the end of blade ring 31′. A blade ring 31′ is maintained in position in relation to body member 30′ by means of the cooperating rib 32′ and slot 33′, these two elements being kept in association with one another by means of a split ring 33A. On FIG. 8, and also shown in FIGS. 9 and 10, there is further provided an O ring 30A against which an end portion of shroud 43′ is arranged to seat. Further, there is shown in each of FIGS. 8 to 10 an impact bar 44 having a square peg connection 44A for cooperation, in use, with the upper part of passageway 34 which, as discussed already, is of square cross-section.

The main variation between the embodiment of FIG. 8 and FIG. 9, is that the embodiment of FIG. 9 does include a bolt 39″ in similar fashion to the bolt 39 of FIG. 7. The bolt 39″ cooperates with a threaded aperture formed in the mandrel 38″. The mandrel 38″ is of generally enlarged proportions as compared with the mandrel 38′.

The embodiment of FIG. 10, is most similar to the embodiment shown in FIG. 8 and differs simply by the mandrel 38‴ being of enlarged proportions as compared to the mandrel 38′.

Figure 11:
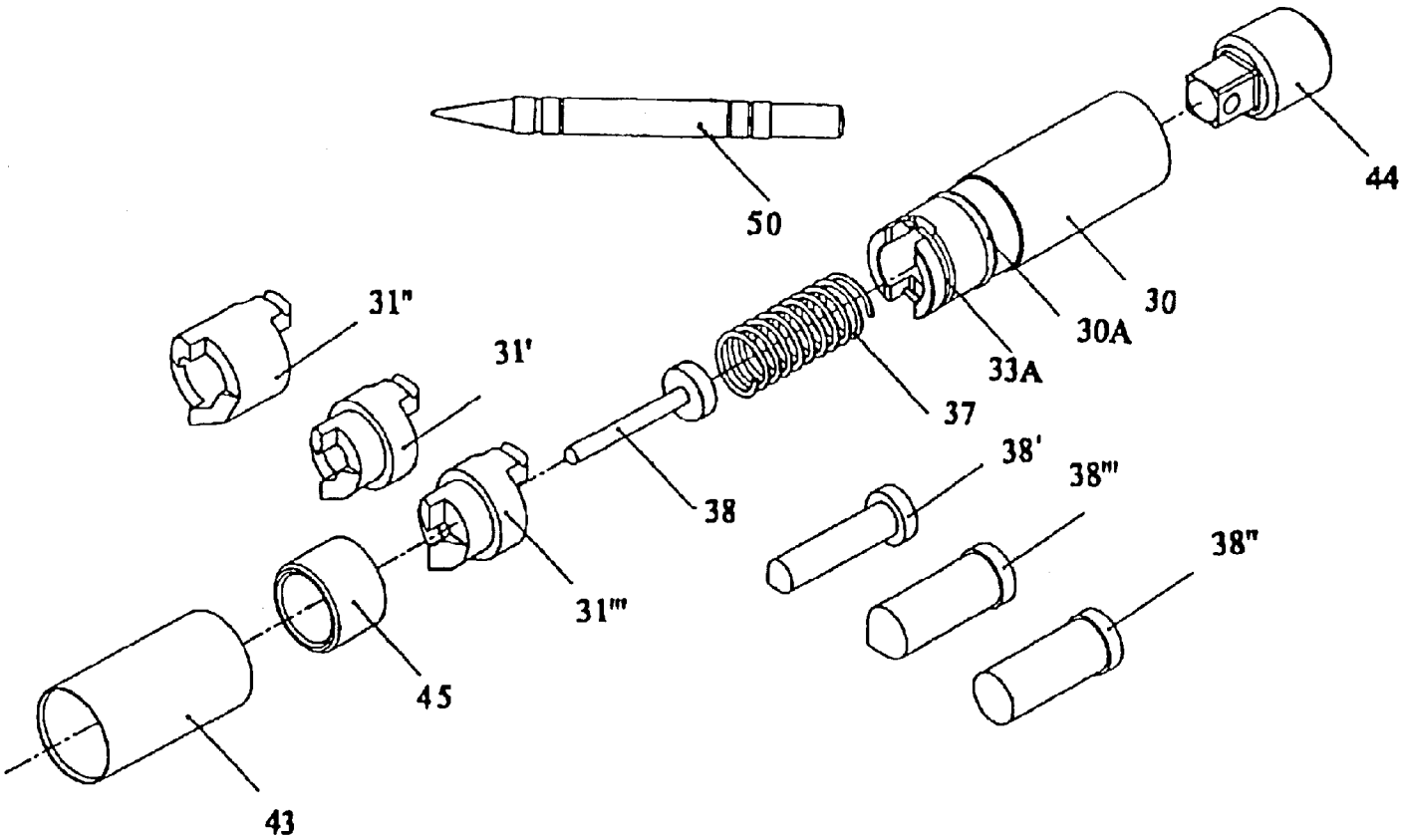

FIG. 11 is an exploded view showing the various different interchangeable parts as referred to previously which path for use with the tool. In addition, FIG. 11 shows (at reference numeral 45) a plastic shroud which assists in centralising the tool when using the blades shown as 31‴ and 31′. It further shows, a centre punch 50 which can be utilised prior to using the tool to mark a centre point on a fastening member which is to be loosened.

It will be appreciated that various modifications may be made to the embodiments of the present invention whilst remaining within the scope of the invention. For instance, the invention includes embodiments of the tool incorporating integral impact driver portions as well as embodiments requiring the use of an external impact driver and embodiments which may use other means of engagement.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A tool for aiding the removal of a fastening member from a structure to which it is attached by means of a threaded connection, the tool comprising: an elongate body member (30) having first and second ends, the first ends having means (31) for deforming an end face of the fastening member to provide an area of purchase thereon; and means (44) to cause rotation of the fastening member to unscrew the fastening member from the structure, the tool being characterized in that a mandrel (38) is provided which is spring mounted within the body member and arranged to engage with the end face of the fastening member for locating the first end of the body member with respect to the end face of the fastening member.

2. A tool according to claim 1, wherein said means to cause rotation comprises attachment means for the attachment of an operating member (44) and wherein the attachment means is located at the second end of the body member (30).

3. A tool according to claim 2, wherein the means to cause rotation further comprises an impact means.

4. A tool according to claim 1, wherein the means for deforming the fastening member comprises at least one cutting means (31′) for biting into said end face.

5. A tool according to claim 4, wherein the cutting means includes at least one angled cutting edge.

6. A tool according to claim 4, wherein the cutting means comprises a blade ring (31) having blades arranged around an aperture formed in the blade ring.

7. A tool according to claim 1, wherein the first end of the body member is provided with an aperture running longitudinally through the center of the body member.

8. A tool according to claim 6, wherein the aperture enables a bolt or similar object, on which is threaded a fastening member, to be lowered into the body member such that the blades (14, 31) come into contact with an end face of said fastening member.

9. A tool according to claim 1, wherein the leading end of the mandrel (38) is tapered.

10. A tool according to claim 1, wherein the tool is provided with means (43) for preventing peripheral damage to the structure.

11. The tool according to claim 10, wherein a cover or shroud (43) is provided to surround the means for deforming the end face of the fastening member.

* * * * *

UNITED STATES PATENT AND TRADEMARK OFFICE

CERTIFICATE OF CORRECTION

PATENT NO. : 6,807,880 B1
APPLICATION NO. : 09/868419
DATED : October 26, 2004
INVENTOR(S) : Ronnie Brain and David Brain It is certified that error appears in the above-identified patent and that said Letters Patent is hereby corrected as shown below:

Title page, item [76] Inventors: should read as follows,

Ronnie Brain, Old Station House, Green Row, Methley, West Yorkshire (GB), LS26 9BR;
David Brain, 14 Brook Street, Fryston Village, Castleford, West Yorkshire (GB), WF10 2PL Signed and Sealed this
Fifteenth Day of May, 2012

David J. Kappos

David J. Kappos
*Director of the United States Patent and Trademark Office*